United States Patent [19]

Vineski

[11] Patent Number: 4,527,887

[45] Date of Patent: Jul. 9, 1985

[54] BLADE CLEANER FOR A CHARGE-RETENTIVE SURFACE

[75] Inventor: John E. Vineski, Rochester, N.Y.

[73] Assignee: Xerox Corporation, Stamford, Conn.

[21] Appl. No.: 527,160

[22] Filed: Aug. 29, 1983

[51] Int. Cl.[3] ..... G03G 21/00

[52] U.S. Cl. ..... 355/15; 15/256.5; 118/652

[58] Field of Search ..... 355/15, 3 R; 15/256.5, 15/256.51; 118/652

[56] References Cited

U.S. PATENT DOCUMENTS

| | | | |
|---|---|---|---|
| 3,838,472 | 10/1974 | Oriel | 355/15 X |
| 3,871,762 | 3/1975 | Van Der Vlaskker | 15/256.51 |
| 4,259,003 | 3/1981 | Mangal et al. | 355/15 X |
| 4,314,756 | 2/1982 | Amitani et al. | 355/15 |
| 4,357,098 | 11/1982 | Endo | 355/15 |

*Primary Examiner*—Richard L. Moses

[57] ABSTRACT

A blade cleaner for removing toner from a charge-retentive surface. The cleaner is characterized by the provision of a powder cloud preventing shield which together with the blade forms a cavity for trapping toner removed from the surface to thereby create a pile of toner at the cleaning edge of the blade which prevents powder clouding.

9 Claims, 3 Drawing Figures

BLADE CLEANER FOR A CHARGE-RETENTIVE SURFACE

This invention relates to printing machines, and more particularly, to a blade cleaner for removing residual toner from a charge-retentive surface utilized therein.

In printing arts of the type contemplated, a charge-retentive surface such as a photoconductor which comprises a photoconductive insulating material adhered to a conductive backing is charged uniformly. Then the photoreceptor is exposed to a light image of an original document to be reproduced. The latent electrostatic images, thus formed, are rendered visible by applying any one of numerous pigmented resins specifically designed for this purpose. In the case of a reusable photoreceptor, the pigmented resin, more commonly referred to as toner which forms the visible images is transferred to plain paper. After transfer, toner images are made to adhere to the copy medium usually through the application of heat and pressure by means of a roll fuser.

Although a preponderance of the toner forming the images is transferred to the paper during transfer, some toner remains on the photoreceptor surface, it being held thereto by relatively high electrostatic and/or mechanical forces. It is essential for optimum operation that the toner remaining on the surface be cleaned thoroughly therefrom.

Another example of a cleaner that has become commercially successful is the blade cleaner. Blade cleaners have become quite popular in recent years due to their simplicity in construction, and their high degree of effectiveness in residual toner removal. When a cleaning blade is positioned above the surface to be cleaned, the toner rapidly builds into a pile in front of the blade which traps and agglomerates the toner particles thereby precluding undesirable powder clouding. However, removal of the toner thus accumulated is more difficult to get rid of than when the blade is positioned below the photoreceptor or adjacent a vertical section thereof. In these locations, however, as the toner falls freely from the photoreceptor to be collected in a sump positioned therebelow, powder clouding is observed.

The problem of powder clouding in connection with blade cleaning where the blade is positioned below the photoreceptor or adjacent a vertical section thereof is solved by the present invention through the provision of a shield which is carried by the blade holder and exends beyond the end and in front of the blade to form a cavity between the blade and the shield wherein toner is trapped and agglomerated such that powder clouding is precluded. The shield is sufficiently flexible so that when the cavity is filled to capacity the blade flexes thereby allowing toner to fall freely to the toner collection system therebelow. An added advantage in the foregoing arrangement is that the toner which is/or contains a lubricant for the blade is available at the working edge of the blade so that the blade has adequate lubrication.

Other aspects of the present invention will become apparent as the following description proceeds with reference to the drawings.

Inasmuch as the art of electrophotographic printing is well known, the various processing stations employed in the printing machine illustrated in FIG. 1 will be described only briefly.

Figure 1:
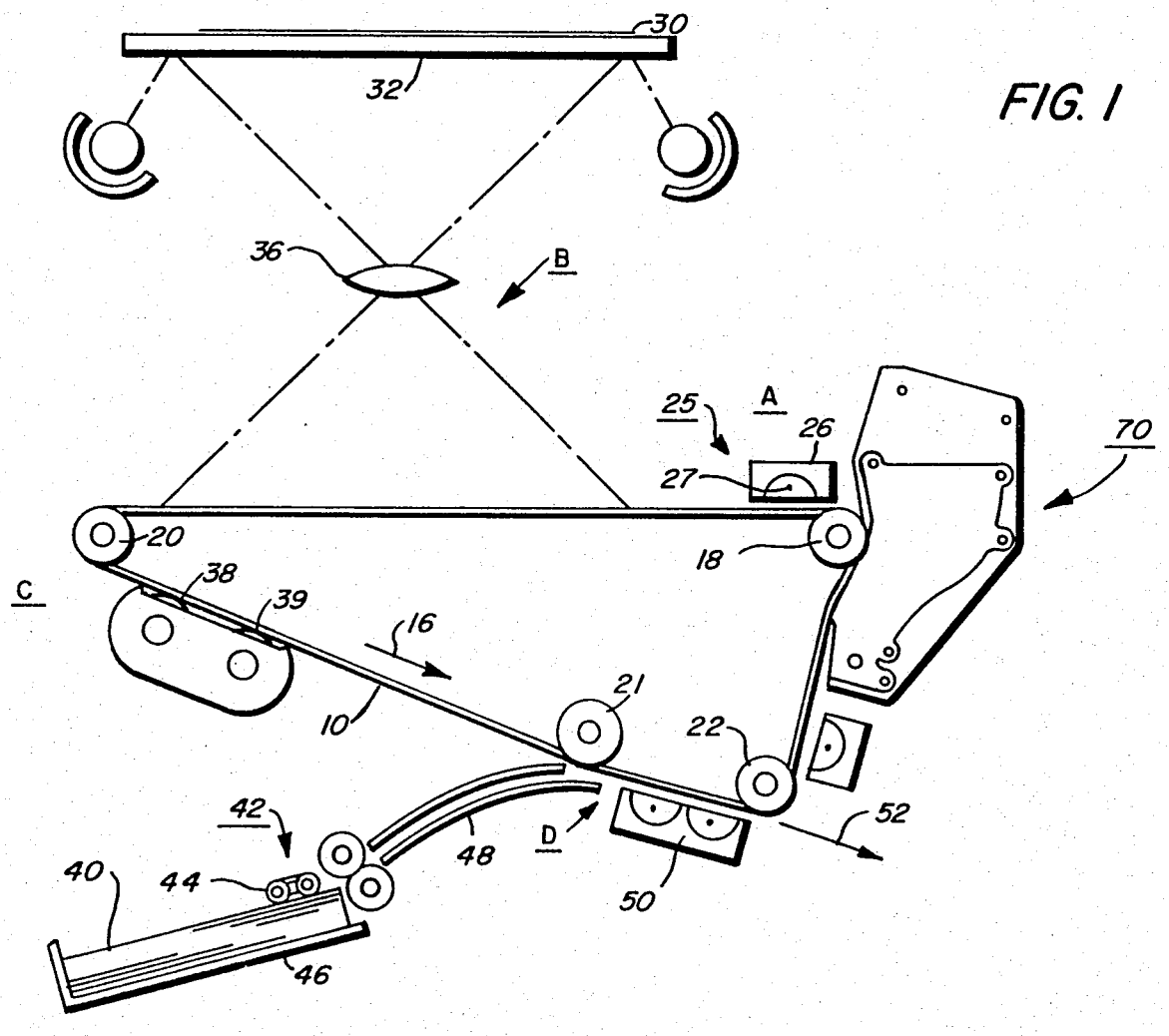
FIG. 1 is a schematic elevational view depicting an electrophotographic printing machine incorporating the present invention.

As shown in FIG. 1, the printing machine utilizes a photoconductive belt 10 which consists of an electrically conductive substrate, a charge generator layer comprising photoconductive particles randomly dispersed in an electrically insulating organic resin and a charge transport layer comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al., the disclosure of which is incorporated herein by reference. Belt 10 moves in the direction of arrow 16 to advance succesive portions thereof sequentially through the various processing stations disposed about the path of movement thereof.

Belt 10 is entrained about drive roller 18, tension roller 20, and idler rollers 21 and 22. Roller 18 is coupled to motor (not shown) by suitable means such as a drive chain.

Belt 10 is maintained in tension by a pair of springs (not shown) resiliently urging tension roller 20 against belt 10 with the desired spring force. Both rollers 21, 22 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charges charge generating layer of belt 10 to a relatively high, substantially uniform negative potential. A suitable corona generating device for negatively charging the photoreceptor belt 10 comprises a conductive shield 26 and corona wire 27 the latter of which is coated with an electrically insulating layer having a thicknes which precludes a net d.c. corona current when an a.c. voltage is applied to the corona wire when the shield and photoreceptor surface are at the same potential.

Next, the charged portion of the photoreceptor belt is advanced through exposure station B. At exposure station B, an original document 30 is positioned face down upon a transparent platen 32. The light rays reflected from original document 30 form images which are transmitted through lens 36; the light images are projected onto the charged portion of the photoreceptor belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer rollers 38 and 39 advance a developer mix (i.e. toner and carrier granules) into contact with the electrostatic latent image. The latent image attracts the toner particles from the carrier granules thereby forming toner powder images on the photoreceptor belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed belt 44 contacting the upper sheet of stack 46. Feed belt 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station (also not shown).

The fusing station includes a fuser assembly which permanently affixes the transferred toner powder images to sheet 40. Preferably, the fuser assembly includes a heated fuser roller adapted to be pressure engaged with a back-up roller with the toner powder images contacting fuser roller. In this manner, the toner powder image is permanently affixed to sheet 40. After fusing, a chute (not shown) guides the advancing sheet 40 to catch tray for removal from the printing machine by the operator.

Figure 2:
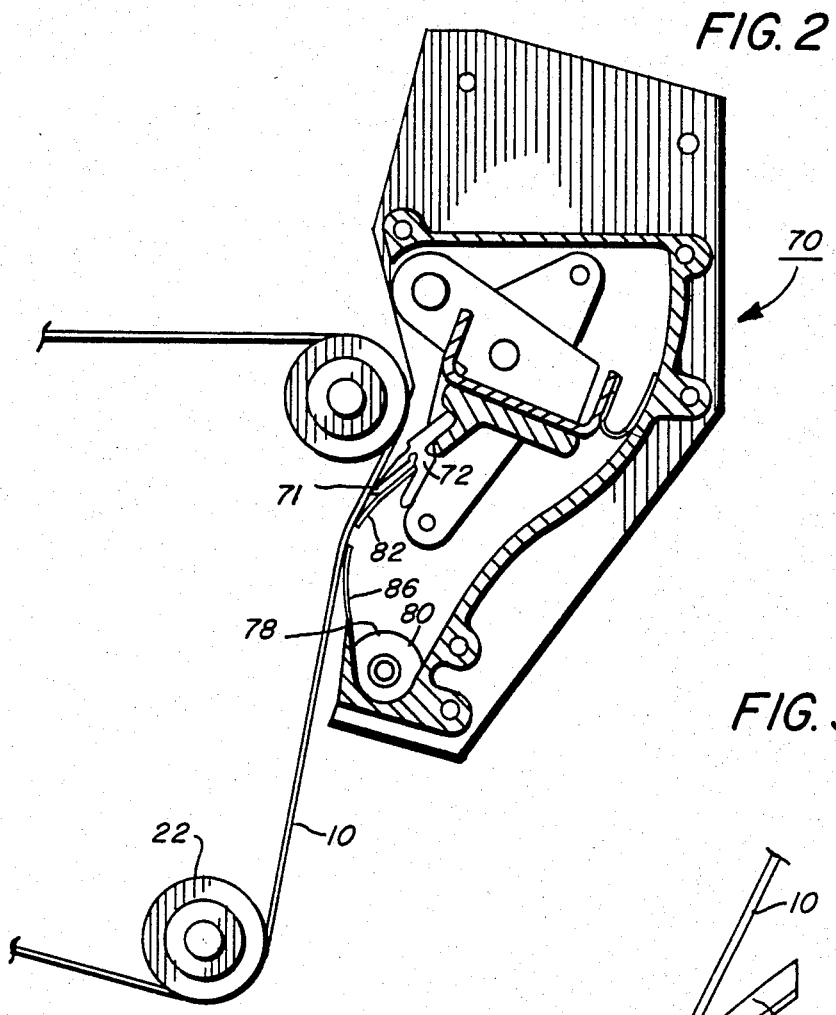
FIG. 2 is an enlarged fragmentary view of a blade cleaner forming a part of the invention.
Figure 3:
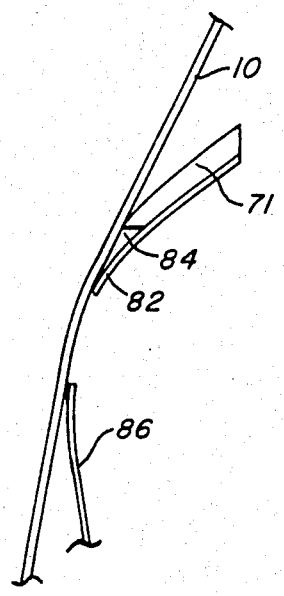
FIG. 3 is an enlarged fragmentary view of the blade cleaner of FIG. 2.

As disclosed in FIGS. 1 and 2, a cleaning structure 70 comprises a blade holder 72 into which a conventional cleaning blade 71 is inserted. The holder is mounted to a machine frame member (not shown) such that the blade edge contacts the photoreceptor surface in the manner shown. As can be observed, the extent of the photoreceptor contacted is inclined from the vertical so that toner which eventually falls to a sump 78 containing an auger 80 will do so without contacting the photoreceptor. A shield 82 also carried by the holder 72 extends beyond the edge of the blade and as illustrated contacts the photoreceptor. This arrangement of the shield and blade forms a cavity 84 which traps toner thereby forming a pile of toner adjacent the blade edge. The pile thus formed is effective in precluding powder clouding. The shield may be fabricated from a relatively thin plastic material so it can ride on the photoreceptor surface and so that it is sufficiently flexible so that the toner that accumulates in the cavity can move beyond the shield and fall into the sump below when the capacity of the cavity is exceeded. A lower seal 86 fabricated from Mylar is provided to insure that the falling toner falls into the sump.

I claim:

1. Printing apparatus comprising:

a charge-retentive surface;

means including toner for forming visible images on said charge-retentive surface;

a cleaning blade;

means for supporting at least one edge of said cleaning blade in contact with said charge-retentive surface such that powder developing material loosened by said cleaning blade tends to fall away from residual said charge-retentive surface; and means carried by said supporting means for preventing said toner loosened by said cleaning blade from falling away from said charge-retentive surface so that it is collected adjacent said at least one edge, said at least one edge thereby becoming immersed in toner whereby powder clouding is precluded.

2. Apparatus according to claim 1 wherein said charge-retentive surface comprises a photoreceptor.

3. Apparatus according to claim 2 wherein said photoreceptor is configured in the shape of a belt.

4. Apparatus according to claim 1 wherein said preventing means comprises a shield held by said supporting means in a position so that a cavity is formed between said charge-retentive surface, said at least one edge and said shield, said cavity being adapted to hold a predetermined quantity of toner.

5. Apparatus according to claim 4 wherein said shield comprises relatively thin rectangular plastic which is capable of being flexed to allow excess toner to pass out of said cavity and into a toner collection sump.

6. Apparatus according to claim 5 wherein said charge-retentive surface comprises a photoreceptor.

7. Apparatus according to claim 6 wherein said charge-retentive surface comprises a photoreceptor.

8. Apparatus according to claim 4 wherein said phtoreceptor is configured in the shape of a belt.

9. Apparatus according to claim 5 wherein said photoreceptor is configured in the shape of a belt.

* * * * *